US009719334B2

(12) United States Patent
Jani

(10) Patent No.: US 9,719,334 B2
(45) Date of Patent: Aug. 1, 2017

(54) METHOD AND TOOL FOR PERFORATING A WELLBORE CASING IN A FORMATION USING A SAND JET, AND USING SUCH TOOL TO FURTHER FRAC THE FORMATION

(71) Applicant: William Jani, Calgary (CA)

(72) Inventor: William Jani, Calgary (CA)

( * ) Notice: Subject to any disclaimer, the term of this patent is extended or adjusted under 35 U.S.C. 154(b) by 195 days.

(21) Appl. No.: 14/637,114

(22) Filed: Mar. 3, 2015

(65) Prior Publication Data

US 2016/0258258 A1 Sep. 8, 2016

(51) Int. Cl.

| | |
|---|---|
| ***E21B 43/114*** | (2006.01) |
| ***E21B 43/26*** | (2006.01) |
| ***E21B 34/10*** | (2006.01) |
| ***E21B 33/124*** | (2006.01) |
| ***E21B 33/129*** | (2006.01) |
| ***E21B 23/00*** | (2006.01) |
| *E21B 34/00* | (2006.01) |

(52) U.S. Cl.

CPC ..... *E21B 43/114* (2013.01); *E21B 23/006* (2013.01); *E21B 33/124* (2013.01); *E21B 33/129* (2013.01); *E21B 34/10* (2013.01); *E21B 43/26* (2013.01); *E21B 2034/007* (2013.01)

(58) Field of Classification Search

None

See application file for complete search history.

(56) References Cited

U.S. PATENT DOCUMENTS

| | | | | |
|---|---|---|---|---|
| 3,120,272 | A * | 2/1964 | Cochran | E21B 33/1265 166/118 |
| 3,414,059 | A * | 12/1968 | Nutter | E21B 23/00 166/128 |
| 2003/0111236 | A1* | 6/2003 | Serafin | E21B 23/06 166/387 |
| 2011/0162846 | A1* | 7/2011 | Palidwar | E21B 43/26 166/298 |
| 2012/0090847 | A1* | 4/2012 | Getzlaf | E21B 23/02 166/305.1 |
| 2013/0248192 | A1* | 9/2013 | Cook | E21B 33/127 166/308.1 |
| 2015/0013982 | A1* | 1/2015 | Getzlaf | E21B 43/26 166/298 |
| 2015/0226028 | A1* | 8/2015 | Ringgenberg | E21B 23/006 166/387 |

(Continued)

*Primary Examiner* — Caroline Butcher

(74) *Attorney, Agent, or Firm* — Gowling WLG (Canada) LLP; D. Doak Horne

(57) ABSTRACT

A tool and method employing sand jetting to perforate a wellbore casing at various locations using sandjetting, and to further flush the wellbore in the region of the tool, and to further frac the formation, all without having to remove the tool from the wellbore. An uphole and downhole packer is provided, uphole of which a sand jet port is provided for jetting a fluid stream containing sand. Locking jaw members and a 'j' slot subassembly, downhole of both the jet port and frac port, are together used to set and unset the tool in the wellbore for the fracking operation. A slidable sleeve is utilized to open and close the jet port, and a piston member is further provided to set the upper packer member. A bypass port, selectively openable and closeable, is provided to assist in moving the tool uphole during the perforating and fracking process.

9 Claims, 5 Drawing Sheets

(56) References Cited

U.S. PATENT DOCUMENTS

2015/0376968 A1* 12/2015 Flores ..... E21B 33/124
166/279
2015/0376975 A1* 12/2015 Flores ..... E21B 33/124
166/377

* cited by examiner

METHOD AND TOOL FOR PERFORATING A WELLBORE CASING IN A FORMATION USING A SAND JET, AND USING SUCH TOOL TO FURTHER FRAC THE FORMATION

FIELD OF THE INVENTION

The present invention relates to a downhole tool for insertion in a wellbore for perforating a casing in such wellbore and further fracking an underground hydrocarbon formation in which such wellbore is located. More specifically, the present invention relates to a tool which has capability to perform perforating, cleaning, and fracking without having to trip the tool out. Various methods for performing operations are further disclosed.

BACKGROUND OF THE INVENTION AND DESCRIPTION OF THE PRIOR ART

The below provided background information and description of prior publications is provided for the purpose of making known information believed by the applicant to be of possible relevance to the present invention. No admission is necessarily intended, nor should be construed, that any of the below publications and information provided constitutes prior art against the present invention.

In order to prepare a cased wellbore drilled in a hydrocarbon formation for production, such cased wellbore first needs to be perforated along portions of its length in order for hydrocarbons to flow into such wellbore for pumping to surface.

Prior art apparati and methods for creating perforations in the wellbore casing have typically comprised placing a string of explosive charges, namely shaped charges adapted to explode radially outwardly, within and along a length of the wellbore, and igniting such charges and thereafter withdrawing the perforating string from the wellbore.

Other methods and apparati for creating perforations along a wellbore have involved insertion of a tool having one or more nozzles, adapted to direct radially outwardly therefrom an abrasive fluid under pressure. Such abrasive high pressure fluid impacts the wellbore casing and due to its abrasive nature, cuts a hole or holes in the wellbore casing. Such tool is moved along the wellbore casing to create additional perforations in such wellbore along a desired length thereof.

Typically, after a wellbore has been perforated, as a means to increase the rate and volume of production from the formation prior to commencing production therefrom a fracking fluid (typically containing proppants, acids, diluents, and/or other flow-stimulating additives) is injected under high pressure into the wellbore in a fracking operation. Typically only portions of a wellbore are "fracked" at a time, requiring a zone of a wellbore that is to be fracked to be isolated from other regions of the wellbore, typically by rubberized packer elements which are actuated by hydraulic pressure.

In such fracking operation, when a particular one or number of perforations along a wellbore are isolated by packers, a high pressure fluid is flowed into the wellbore and thus into the formation in the region of the perforation(s). Such high pressure fluid creates fissures within the formation. The created fissures (typically lines of fracture within the formation) generally emanate radially outwardly from the wellbore and thereby create flow channels in the formation which lead to the wellbore, thereby assisting hydrocarbons to subsequently flow into and be collected by the wellbore.

Unsatisfactorily however, no tool exists that is able to both perforate using abrasive jets, as well as carry out fracking operations without having to use separate tools and trip the tool out, in an effective and efficient manner.

U.S. Pat. No. 4,781,250 to McCormick et al., entitled "Pressure Actuated Cleaning Tool" teaches a downhole tool for cleaning tubing, casing and flow lines with pressurized cleaning fluid pumped through coiled tubing. The cleaning tool is rotated by a "J"-slot indexing tool, which activated by fluid pressure changes and a spring, to effectively rotate the tool 360°. McCormick et al does not, however, disclose any apparati or method on the same tool for further being able to carrying out fracking of the formation via the perforations created by such same tool.

U.S. Pat. No. 7,963,332 to Dotson, entitled "Apparatus and Method for Abrasive Jet Perforating", teaches a device using an abrasive jet for perforating, with a mechanical locating collar. Such patent however does not teach any sliding sleeve to open and close the perforating jet, nor does it teach use of such perforator jet, in combination with a packers, a bypass, a "j" slot used to set and release a setting tool, and frac ports, all incorporated into and for use by the same tool to permit both perforating and fracking using the same tool.

Likewise, and to similar effect, U.S. Pat. No. 8,757,262 similarly to Dotson, entitled "Apparatus and Method for Abrasive Jet Perforating and Cutting of Tubular Members", teaches an abrasive jet perforating tool, coupled rotatably to a tubing string, and a horizontal indexing tool coupled thereto. An extension tool with a protective sleeve is used to protect the apparatus. Again, however, such patent fails to disclose any apparati or method on the same tool for further being able to carrying out fracking of the formation via the perforations created by such same tool.

U.S. Pat. No. 5,765,756 by Jordan et al., entitled "Abrasive Slurry Jetting Tool and Method" teaches an abrasive jet perforating tool with telescoping jet nozzles. The jetting nozzles are operated perpendicularly to the longitudinal axis of the tool body, although the nozzle assemblies can pivot back into the tool body for retrieval back up the wellbore. Jordan et al similarly fails to disclose a single tool with further components which allow not only perforation but also setting of the tool to frac as well as perforate, or a method by which fracking and perforation using an abrasive jet may be accomplished by a single tool.

Accordingly, a clear need exists in the wellbore completion industry for a tool which uses abrasive jetting to create perforations in wellbore casings, and which may further accomplish fracking of the formation using the same tool, to thereby save time and speed completion of wellbores in preparation for hydrocarbon production therefrom.

SUMMARY OF THE INVENTION

In a broad aspect of the present invention, the present invention provides a downhole tool which may not only use abrasive jet, such as a fluid containing and having dispersed therein an abrasive material(s) such as sand or silica granules for creating perforations in a wellbore casing, but which may further, during the creation of perforations in the wellbore casing, frack the formation by injection of frack fluid into the formation via the perforations created in the casing.

Advantageously, the tool of the present invention is further able to flush the wellbore when carrying out such perforation and fracking operation, so as to thereby clear the wellbore of detritus created as a result of the creating of perforations within the wellbore casing.

Accordingly, in broad aspect of the present invention, the invention relates to a downhole tool for creating perforations in a wellbore casing and further injecting a fluid in the created perforations using such tool, comprising:

an elongate substantially cylindrical member, having a hollow bore and an outer periphery, adapted for insertion in a wellbore, comprising:

(i) an uphole cylindrical, hollow slidable sleeve within the bore;

(ii) a jet port, situated in said outer periphery, configured to direct a stream of pressurized abrasive fluid radially outwardly from the tool, fluid communication of said jet port with the bore allowed and prevented by slidable movement of the slidable sleeve;

(iii) an uphole packer member, situated on a portion of the periphery downhole of the jet port;

(iv) an expandable chamber and associated piston member, said chamber adapted to receive fluid under pressure from the bore and cause said associated piston member, when pressurized fluid is supplied to the bore, to compress and outwardly expand the uphole packer member;

(v) a downhole packer member, situated on a portion of the periphery downhole of said uphole packer member;

(vi) a frac port in said periphery of the cylindrical member, intermediate the uphole and downhole packer members;

(vii) a slidably moveable guide member, situated on said cylindrical member having radially protruding slip members thereon configured to frictionally engage said wellbore casing when the tool is inserted therein, said guide member situated on said tool downhole of the downhole packer member, said guide member further having radially expandable jaw members on an uphole side thereof; and (viii) a 'j' slot subassembly within said tool situated downhole of the downhole packer member, coupled to an associated cylindrical hollow mandrel;

wherein said 'j' slot subassembly, when downward force is applied to said tool and said guide member frictionally engages said wellbore casing, said 'j' slot subassembly does not allow further relative downward movement of a lower portion of said downhole packer member relative to said guide member and thus does not allow said jaw members to become actuated; and wherein said 'j' slot sub-assembly, when an upward pulling force is applied to said tool and thereafter a downward force is re-applied to said tool, is then in a 'set' position where:

(i) said lower portion of said downhole packer member is allowed further downward downhole movement to allow said lower portion of said downhole packer member to be forced against said jaw members so as to expand them radially outwardly to engage said wellbore casing.

In a further preferred embodiment, to assist in moving the tool uphole after having created a perforation in the wellbore casing, a bypass port in said periphery of the cylindrical member uphole of the downhole packer, is provided. Such bypass port when open provides fluid communication between an exterior of the tool and the bore of the tool and permits fluid exterior to the tool and above said downhole packer to flow into said bore and bypass the downhole packer. A slidable valve member slidably opens and closes the bypass port. When an upward force is exerted on the tool, the slidable valve member is in an open position. When the 'j' slot is subsequently operated to the 'set' position by subsequent downward force on the tool and/or a fluid pressure is applied to the bore of the tool, the slidable valve is moved to a closed position thereby closing the bypass port.

In either of the above embodiments, the slidable sleeve is adapted to be moved so as to uncover the jet port when either:

(i) the guide member remains at a specific location within said wellbore casing and said remainder of said tool is raised uphole;

(ii) when a pick-up tool is inserted within the wellbore and within the tool, to slidably reposition the slidable sleeve; or (iii) when hydraulic fluid pressure applied to the bore of the tool causes the slidable sleeve to then move to a position where the jet port is then open.

In a further preferred embodiment, the bore of the tool, in the region of the frac port, is provided with a deflector, typically a conical deflector, to deflect fracking fluid from within the bore of the tool out the frac port.

In a further preferred embodiment, an annular cup seal is provided on the periphery of the tool intermediate the jet port and the downhole packer member, which reduces flow of abrasive pressurized fluid and associated wellbore casing cuttings downhole.

In a further broad aspect of the present invention, such invention comprises a method for creating perforations in a wellbore casing using jet abrasion and fracturing a hydrocarbon formation by injecting a pressurized fracking fluid into said formation via the created perforation without having to trip a jet abrasion tool out of said wellbore. Such method at least in part comprising the steps of:

(i) running the tool, which possesses a hollow bore in the region of a jet port and a frac port thereon, into the wellbore casing to a desired depth within the wellbore casing;

(ii) causing a slidable sleeve covering the jet port to move so as to allow fluid communication between the bore of said tool and the jet port;

(iii) injecting an abrasive pressurized fluid within the wellbore and within the bore and causing the jet port to expel the abrasive fluid in a radially outward manner to thereby create a perforation in the wellbore casing at said desired depth;

(iv) ceasing injection of the abrasive pressurized fluid;

(v) pulling upwardly on the tool to position the created perforation along the wellbore casing between an uphole and downhole packer member situated on such tool;

(vi) pushing slightly down on an upper portion of the tool to thereby push the slidable sleeve back over the jet port so as to close the jet port and to further cause jaw members on such tool to be forced against the wellbore casing so as to thereby secure the tool within the wellbore casing and to cause the downhole packer member to became compressed and to expand radially outwardly;

(vii) injecting a pressurized fracking fluid into the wellbore casing and into the bore, and causing a piston member in the tool to compress the uphole packer member and cause the uphole packer member to expand same radially outwardly, and causing the pressurized fluid to pass into the created perforation via the frac port;

(viii) ceasing supply of the pressurized fracking fluid; and (ix) pulling upwardly on the tool to disengage the jaw members and re-position the tool further uphole for creating further perforations and injecting further frac fluid into further created perforations.

In a further refinement of the above method, step (vi) further comprises the step, when pushing downwardly on a portion of the tool uphole of the downhole packer, of closing a bypass port to thereby prevent the otherwise bypass of the fracking fluid downhole.

In a further refinement of the above method, step (ii) further comprises the step of pulling an uphole portion of the tool uphole to thereby move said slidable sleeve upward so as to uncover said jet port.

In an alternative embodiment, step (ii) further comprises the step of inserting a pick up tool within the wellbore casing and the bore of said tool to move said slidable sleeve uphole to a position uncovering said jet port.

In all of the foregoing embodiments, the pressurized abrasive fluid and said pressurized fracking fluid may be one and the same fluid.

In a further preferred embodiment of the above method, such method includes a cleaning or flushing step, to flush detritus in the wellbore resulting from the abrasive perforation step. In such further preferred embodiment, the method further comprises a step, after step (iii) but prior to the injection of pressurized fracking fluid in step (vii), of injecting a flushing fluid to flush the tool and/or the annular region between the wellbore casing and the tool with said flushing fluid to thereby flush abrasive fluids and/or wellbore casing of such detritus. The flushing/cleaning fluid may be circulated in the region of the tool by applying a high pressure cleaning fluid to the bore of the tool, and causing the jet port and/or frac port to expel such fluid into the annular region between the tool and the wellbore, where either or both of the uphole and downhole packer members prevent the flow of such cleaning fluid downhole, and which flushing/cleaning fluid is then flowed uphole and recovered from surface, thereby cleaning and flushing the entirely of the wellbore uphole of the tool, and in the region of the tool uphole from one or both of the uphole and downhole packer members Lastly, in a further refinement of the invention to further decrease the time to both perforate and frac, the abrasive pressurized fluid and the pressurized fracking fluid are one and the same fluid. In such embodiment, simultaneously with step (vii), by injection of such abrasive/fracking fluid to frac the formation, the slidable sleeve is caused to move to an open position and expelling said abrasive/fracking fluid in a radially outward manner via said jet port to thereby create a further perforation in said wellbore, and step (ix) further comprises the step of repositioning the tool further uphole so as to further position said upper packer member on said tool above said further perforation, and again supplying the abrasive/fracking fluid to the tool when in said further position to additionally frac the formation in the region of the further perforation in the wellbore.

In such embodiment/refinement, due to carrying out a perforation and a fracking operations at the same time, the time to both perforate a wellbore and frac the formation can accordingly advantageously be further reduced.

BRIEF DESCRIPTION OF THE DRAWINGS

Further advantages and permutations and combinations of the invention will now appear from the above and from the following detailed description of the various particular embodiments of the invention, taken together with the accompanying drawings each of which are intended to be non-limiting, in which.

DETAILED DESCRIPTION OF SOME PREFERRED EMBODIMENTS

Figure 1:
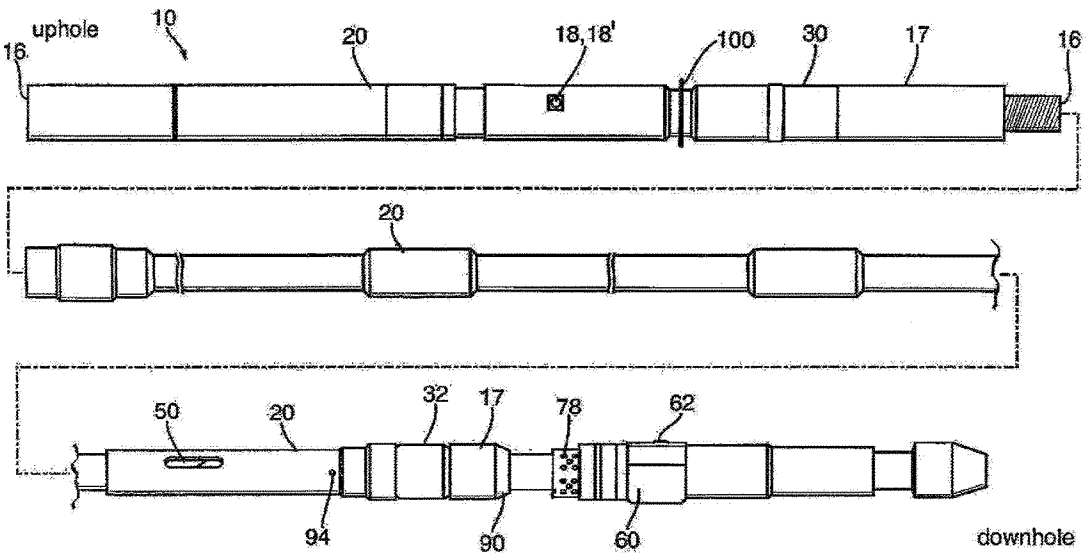
FIG. 1 is a perspective view of the downhole tool of the present invention, broken into three individual segments for illustrative purposes only.

In the following description, similar components in the drawings figures are identified with corresponding same reference numerals.

Figure 2A:
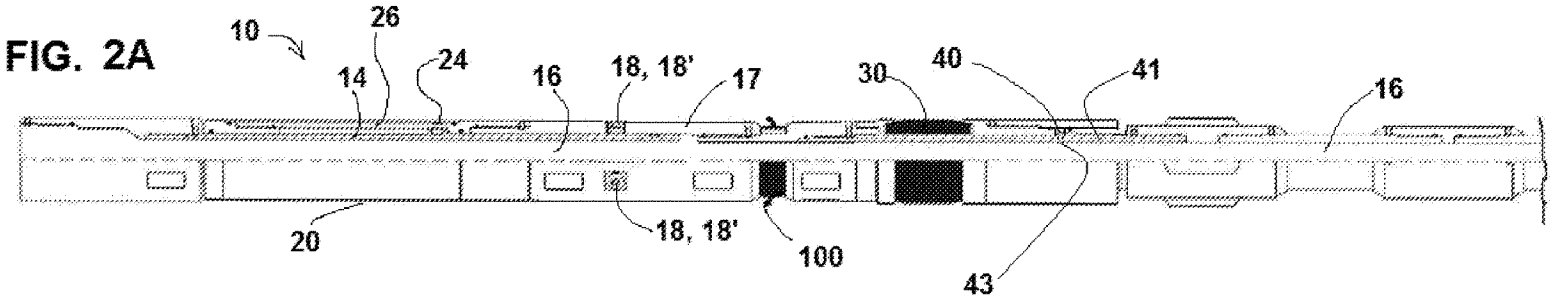
FIG. 2A is a partial cross-sectional view of a first embodiment of the downhole tool, showing the upper portion of the tool, with the uphole portion of the tool being positioned on the left-hand side of FIG. 2A, when the tool is being "run" into the wellbore.
Figure 3A:
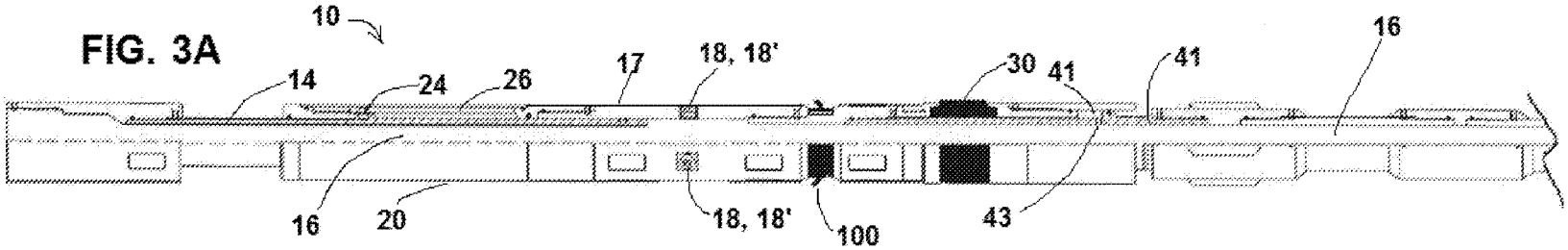
FIG. 3A is a partial cross-sectional view of the same first embodiment of the downhole tool, again showing the upper portion of the tool, with the uphole portion of the tool being positioned on the left-hand side of FIG. 3A, but instead when the tool is in the "pulling" position wherein a portion of the tool having been pulled uphole for effecting operation of the 'j' slot.
Figure 4A:
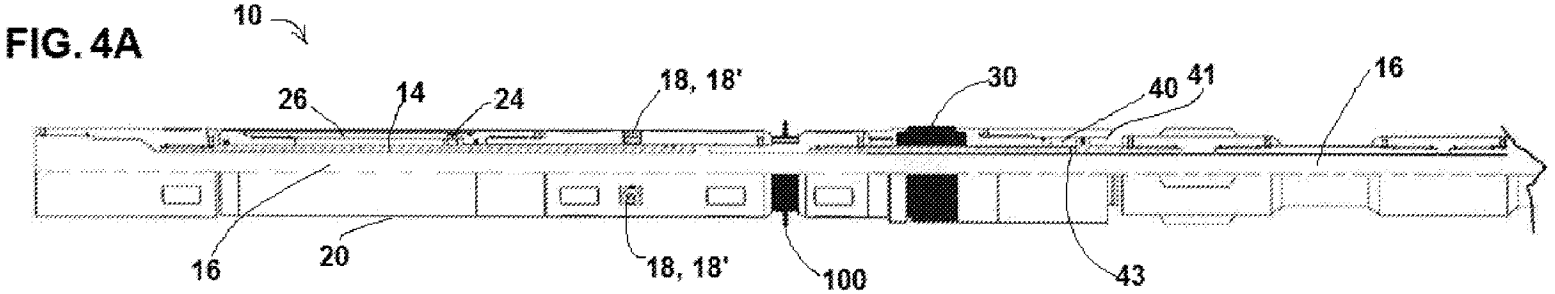
FIG. 4A is a partial cross-sectional view of the same first embodiment of the downhole tool, again showing the upper portion of the tool, with the uphole portion of the tool being positioned on the left-hand side of FIG. 4A, but instead when the tool is in the "set" position after a downhole force has subsequently been applied to the tool from the "pulling" position shown in FIG. 3A & FIG. 3B.
Figure 2B:
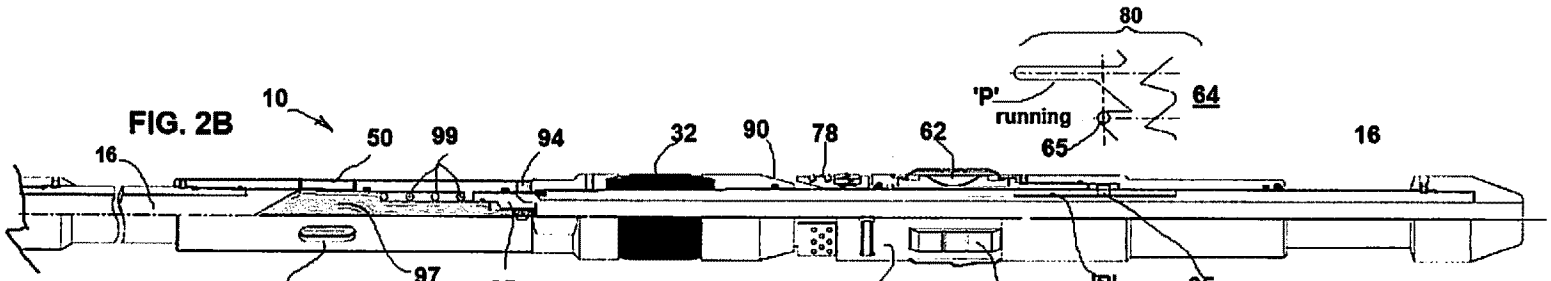
FIG. 2B is a partial cross-sectional view showing the lower portion of the tool of FIG. 2A, with the downhole portion of the tool being positioned on the right hand side of FIG. 2B and when the tool is being "run" into the wellbore, further showing in relief a view on the exterior of the tool in the region of 'j' slot, showing the position of such 'j'-slot sub-assembly when the tool is in the "running" position.
Figure 3B:
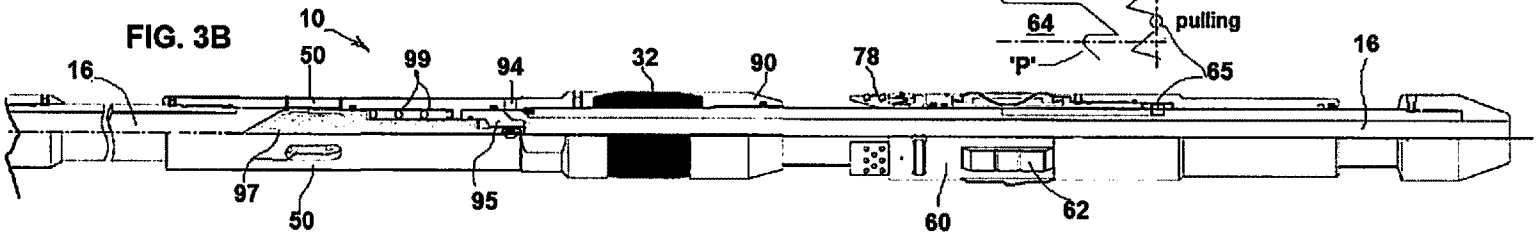
FIG. 3B is a partial cross-sectional view of the same first embodiment of the downhole tool shown in FIG. 3A, showing the lower portion of the tool, again showing the downhole portion of the tool being positioned on the right-hand side of FIG. 3B, when the tool is configured in the "pulling" position, further showing in relief a view on the exterior of the tool in the region of 'j' slot sub-assembly, showing the position of such 'j'-slot sub-assembly when the tool is in the "pulling" position.
Figure 4B:
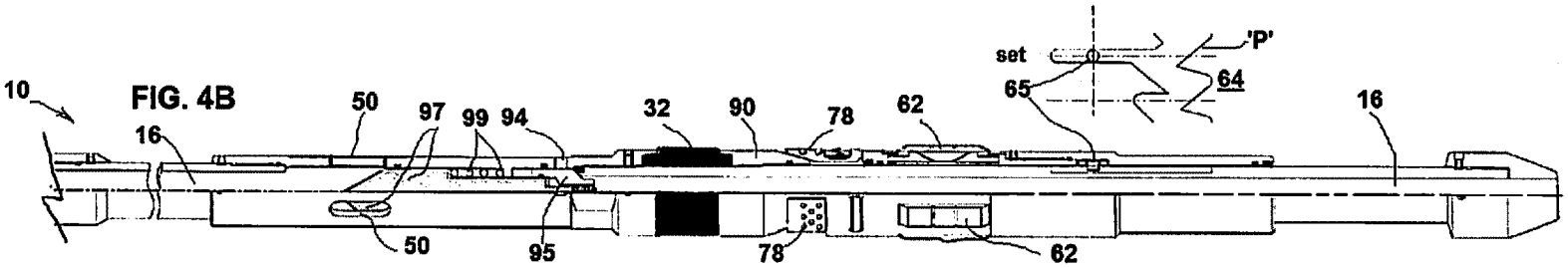
FIG. 4B is a partial cross-sectional view of the same first embodiment of the downhole tool shown in FIG. 4A, showing the lower portion of the tool, again showing the downhole portion of the tool being positioned on the right-hand side of FIG. 4B, when the tool is configured in the "set" position, further showing in relief a view on the exterior of the tool in the region of 'j' slot sub-assembly, showing the position of such 'j'-slot sub-assembly when the tool is in the "set" position.

FIG. 1 and FIGS. 2A, 2B, 3A, 3B, 4A, 4B together illustrate one embodiment of the downhole tool 10 of the present invention, with FIG. 1 depicting the tool 10 separated into three individual segments for illustrative purposes only, with remaining FIGS. 2A, 3A, and 4A showing an upper portion of the same tool 10 in three successive stages of operation (as hereinafter further explained), with corresponding FIGS. 2B, 3B, and 4B showing the lower portion of the same tool 10 in the same three successive stages of operation.

As may be seen, tool 10 is adapted for insertion in a wellbore casing (not shown), and comprises an elongate substantially cylindrical member 20. Cylindrical member 20 possesses a hollow bore 16 for receiving pressurized abrasive fluid and a frac fluid (which in one particular embodiment, as mentioned above, may be one and the same fluid), and further possesses an outer periphery 17. A cylindrical hollow slidable sleeve 14 is positioned within bore 16, adapted for longitudinal slidable movement along bore 16 in a reciprocating manner.

One or more jet ports 18 are provided in outer periphery 17 which are configured to direct a stream of pressurized abrasive fluid, typically a fluid containing quantities of sand and/or silica granules, radially outwardly from the tool 10, for impacting and creating perforations in a surrounding wellbore casing. Jet ports 18, typically two or more being located at a similar longitudinal position along cylindrical member 20 as shown in FIGS. 2A-4A and 6A-8A, typically comprise jet nozzles 18' of hardened steel having an single aperture therein, which are threadably inserted into periphery 17 of tool 10 and are retained in periphery 17 by threaded bosses 19.

In one preferred embodiment the diameter of an exit aperture in each jet nozzle 18' is 0.0241 inches (0.61 mm) for creating perforations in the wellbore casing of similar size. At pressures of approximately 3,000 psi (20,685 kPa), with production wellbore casing thicknesses of ¼ inch (6.35 mm) (Schedule 20) carbon steel for a nominal 8.625 inch (193 mm) o.d. casing, with fine silica sand of 20-40 API mesh size (0.84-0.42 mm) (ie. diameter less than 0.241 inch) and three nozzles, the penetration time using a jet nozzle 18' will take in the range of 30 seconds to create a perforation of desired size in the casing. A similar time to perforate a wellbore casing exists when the casing is of cement as opposed to carbon steel.

The size of perforations desired to be created in wellbore casing (which is in turn dependent upon, inter alia, the characteristics (temperature, viscosity, and physical properties of the actual hydrocarbons which are being recovered from the underground formation) will determine the size of the aperture of each nozzle 18". Typically two, and up to four, jet nozzles 18' will be located at a similar longitudinal position on periphery 17 of cylindrical member 20. For optimum adaptability of tool 10, threaded bosses 19 on periphery 17 to tool 10 in which the jet port nozzles 18' are threadably inserted are adapted to receive a variety of nozzles 18' of varying apertures diameters, depending on the size of the perforations desired to be created in the wellbore casing.

Figure 7A:
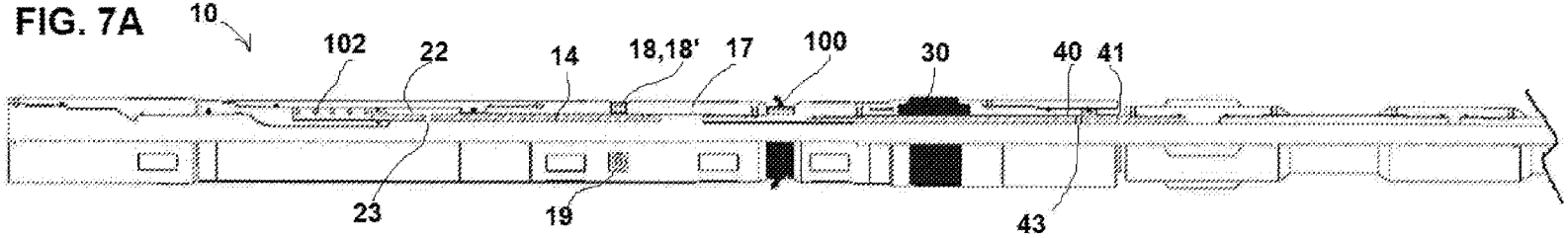
FIG. 7A is a partial cross-sectional view of the same second embodiment of the downhole tool, again showing the upper portion of the tool (the lower portion of the tool remaining the same as in FIG. 3B), with the uphole portion of the tool being positioned on the left-hand side of FIG. 7A, but instead when the tool is in the "pulling" position wherein a portion of the tool having been pulled uphole for effecting operation of the 'j' slot.
Figure 8A:
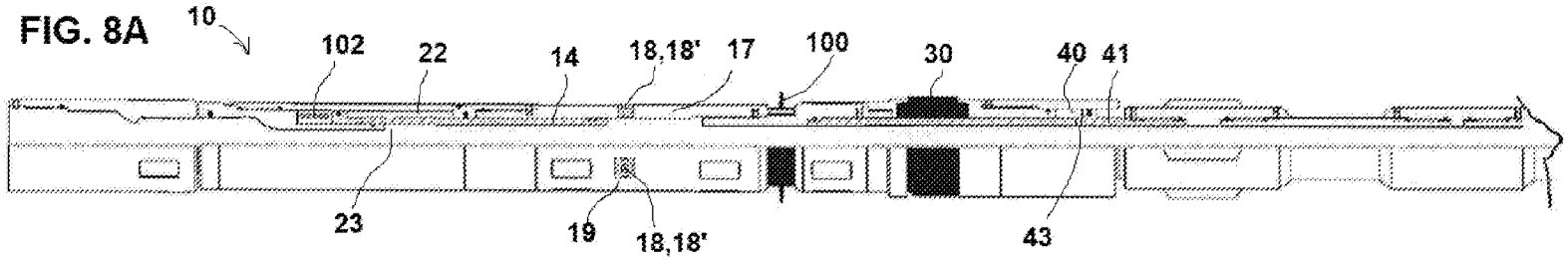
FIG. 8A is a partial cross-sectional view of the same second embodiment of the downhole tool, again showing the upper portion of the tool (the lower portion of the tool remaining the same as in FIG. 4B), with the uphole portion of the tool being positioned on the left-hand side of FIG. 8A, but instead when the tool is in the "set" position after a downhole force has subsequently been applied to the tool from the "pulling" position shown in FIG. 7A.

Fluid communication between jet ports 18 (jet nozzles 18') and inner bore 16 is regulated by slidable sleeve 14, which when slidably positioned over jet ports 18 prevents fluid communication between bore 16 and jet ports 18, effectively closing the jet ports 18. Movement of slidable sleeve 14, either by: (i) application of an uphole force to draw slidable sleeve 14 upward (ref. FIG. 3A), (ii) use of a "pick-up" tool (not shown), inserted downhole into bore 16 when tool 10 is at a location along a wellbore where a perforation therein is desired to be created, or (iii) by injection of a pressurized fluid in bore 16 which thereafter enters chamber 22 and causes slideable sleeve 14 to act as a piston (ref. FIG. 7A,8A) so as to thereby be caused to move so as to open jet port 18, are all alternative and different ways in which slidable sleeve 14 may be actuated to respectively allow and prevent fluid access from bore 16 to jet ports 18.

In the embodiment of the invention shown in FIGS. 2A, 3A, and 3B, slidable sleeve 14 is guided by a pin member 24 travelling in longitudinal slot 26 to ensure longitudinal guided movement of slidable sleeve 14 within cylindrical member 20 and bore 16, and to provide extremities of movement for such slidable sleeve 14.

An uphole packer member 30 is situated on a portion of periphery 17 of tool 10, downhole of jet ports 18. An expandable chamber 40 and associated piston member 41 are provided, wherein chamber 40 is adapted to receive fluid under pressure from bore 16 and cause said associated piston member 41, when pressurized fluid is supplied to bore 16, to compress and outwardly expand uphole packer member 30 to create a seal in the wellbore, between the tool and the wellbore casing.

A downhole packer member 32 is further provided, situated on a portion of periphery 17 of tool 10 downhole from uphole packer member 30, as shown in FIGS. 1, 2B, 3B, & 4B. Downhole packer member 32 is typically comprised of an elastomeric substance, and in uncompressed when in a non-activated state, as shown in FIGS. 2B & 3B. Upon high pressure fluid, such as fracking fluid, being provided to bore 16, such high pressure fluid flows into chamber 40 via aperture 43 in piston member 41, causing expansion of chamber 40 as may be seen in FIG. 3A. Expansion of chamber 40 causes piston member 41 to compress uphole packer member 30, thereby creating a seal between tool 10 and wellbore casing at the location of uphole packer member 30 in the wellbore.

One or more frac ports 50 are provided on tool 10 circumferentially about the periphery 17 of cylindrical member 20. Frac ports 50 are located on tool 10 intermediate uphole packer member 30 and downhole packer member 32.

A slidably moveable guide member 60, having radially protruding slip members 62 which frictionally engage the wellbore casing when tool 10 is inserted in the casing, is provided. Guide member 60 is situated on tool 10 downhole of downhole packer member 32. Guide member 60 is further provided with radially expandable jaw members 78, on an uphole side thereof, as shown in FIGS. 2B, 3B & 4B.

A 'j'-slot subassembly 80 is provided on tool 10, situated downhole of downhole packer member 32. 'J'-slot subassembly 80 comprises an inner mandrel member 64, having a slotted profile "P" therein, and a pin member 65 which travels in slotted profile "P".

Figure 6A:
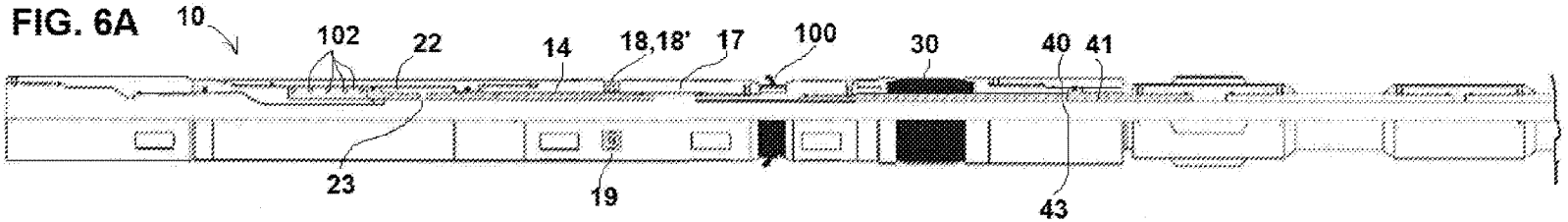
FIG. 6A is a partial cross-sectional view of a second embodiment of the downhole tool, showing the upper portion of the tool (the lower portion of the tool remaining the same as in FIG. 2B), with the uphole portion of the tool being positioned on the left-hand side of FIG. 6A, when the tool is being "run" into the wellbore.

When the 'j'-slot subassembly 80 is in the 'run' position (ref. FIG. 2A, 2B, and FIG. 6A) and downward force is applied to tool 10 guide member 60 frictionally engages the wellbore casing. In such "run" position, the slotted profile "P in associated mandrel member 64 does not allow further relative downward movement of a wedge-shaped lower portion 90 of downhole packer member 32, and thus does not allow jaw members 78 to become actuated.

When an upward pulling force is applied to tool 10 (ref. FIG. 3A, 3B, and FIG. 7A) and thereafter a downward force is re-applied to said tool 10 (ref. FIG. 4A, 4B, and FIG. 8A), the 'j'-slot subassembly becomes configured in the 'set' position where:

(i) the wedge-shaped lower portion 90 of downhole packer member 32 is allowed further downward downhole movement to allow said lower portion 90 to be forced against jaw members 78 so as to expand them radially outwardly to engage the wellbore casing, and thereby fix the tool 10 within the wellbore casing to allow fracking to be carried out.

In a preferred embodiment a bypass port 94 is provided, uphole of the downhole packer member 32, configured when open to provide fluid communication between an exterior of tool 10 and interior bore 16 and permit fluid exterior to tool 10 and above said downhole packer member 32 to flow into said bore. With such bypass port 94 the tool 10 may be more easily pulled uphole than would otherwise be the case. A slidable valve member 95 slidably opens and closes said bypass port 94.

When an upward force is exerted on the tool 10 slidable valve member 95 is in an open position thereby keeping open bypass port 94. When subsequently actuating said 'j' slot subassembly 80 to the 'set' position by subsequent downward force on tool 10, and/or frac pressure is applied to bore 16, slidable valve member 95 is moved to a closed position thereby closing bypass port 94.

In the embodiments of the tool shown in FIGS. 2B, 3B, & 4B, the slidable valve member 95 which is provided is moved to the closed position in FIG. 4B, by hydraulic frac fluid being applied to bore 16, which thereby moves spring-biased conical deflector 97 downhole, thereby moving slidable valve member 95 to cover and thereby close bypass port 94. In an alternative configuration (not shown) mandrel 64 may further or alternatively be configured, to that when the "j'-slot subassembly 80 is in the "set" position, that bypass port 94 is thereby closed, either by mandrel 64 itself, or by mandrel 64 actuating slidable valve member 95 to close bypass port 94.

Numerous other configurations to effectively close bypass port 94 upon 'j' slot subassembly 80 moving to the "set" position (as shown in FIG. 4B) will now occur to persons of skill in the art, and all such variations are within the contemplation of this invention. Similarly, conical deflector 97 is shown in FIGS. 2B & 3B as being biased by a helical coil spring 99 to close port 50 and leave bypass port 94 open, unless a fluid pressure is supplied to bore 16 to thereby move conical deflector 97, to leave slidable valve member 95 in a position where bypass port 94 is closed and port 50 is open (ref. FIG. 4B). Other means of biasing conical deflector 97, other than by spring means, to accomplish the aforesaid result will now occur to persons of skill in the art, and such permutations and substitutions are likewise contemplated as forming the invention described herein.

FIGS. 6A, 7A, 8A show successive operation of an alternative embodiment of the upper portion of the tool 10 (the bottom portion of the tool 10 being identical to the configurations successively depicted in corresponding successive FIGS. 2B, 3B, & 4B) in particular with regard to the manner of actuation of the sliding sleeve 14, where such embodiment is specifically adapted to both perforate and frac at the same time.

The components of the bottom portion of the tool 10, for the embodiment shown in successive FIGS. 6A, 7A, & 8A, are identical and correspond to the configuration shown in corresponding successive FIGS. 2B, 3B, and 4B. Specifically, FIG. 6A (and corresponding bottom portion of the tool 10 in such embodiment shown in FIG. 2B) shows the tool 10 of such embodiment in the "run in" position. FIG. 7A (and corresponding bottom portion of the tool 10 in such embodiment shown in FIG. 3B) shows the tool 10 of such embodiment in the "pulling" position. Lastly, FIG. 8A (and corresponding bottom portion of the tool 10 in such embodiment shown in FIG. 4B) shows the tool 10 of such embodiment in the "set" position.

In such alternative embodiment shown in FIGS. 6A, 7A, and 8A, slidable sleeve 14 has a port 23 therein and is configured so as to form a chamber 22. After the tool 10 is moved slightly uphole to the "pulling" position shown in FIGS. 7A & 3B) and then moved downwardly to allow the 'j'-slot to move to the "set" position (ref FIGS. 8A & 4B) pressurized abrasive fluid is the supplied to bore 16 of tool 10. Such pressurized fluid enters chamber 22 via port 23 and causes slidable sleeve 14 to automatically move uphole as shown in FIG. 8A, thereby uncovering jet port 18 to thereafter allow the perforation operation to be performed. In this alternative embodiment/alternative method, the pressurized abrasive fluid also serves as the fracking fluid. In such case, the foregoing embodiment allows simultaneous creation of an uphole perforation in the wellbore casing when such sliding sleeve 14 is opened, while at the same time fracking of the formation being simultaneously conducted by a lower portion of the tool 10, since upper and lower packer members 30, 32 respectively now "straddle" an earlier-created perforation in the wellbore casing, and pressurized abrasive/fracking fluid is injected into the formation via such lower earlier-created perforation.

In the preferred embodiments of the upper portion of the tool 10 shown in FIGS. 2A, 3A, & 4 A, and 6A, 7A, & 8A, such upper portion 10 is provided with an annular cup seal 100 on periphery 17 of tool 10. Such annular cup seal 100 is situated intermediate jet port 18 and said downhole packer member 32, and serves to reduce flow of abrasive pressurized fluid and associated wellbore casing cuttings downhole during the casing perforation operation, which is part of the method of the present invention more fully explained below.

Manner of Operation of Tool, and Methods for Perforating Wellbore Casing and Fracking a Formation Using the Single Tool A broad outline of a method for operating the tool 10 and methods for perforating a wellbore casing and fracking a formation using a single tool 10 are set out below and are depicted successively in FIGS. 2A, 2B, 3A, 3B & 4A, 4B, and likewise successively for the alternative embodiment shown in FIGS. 6A, 7A & 8A (with corresponding lower portions of the tool 10 shown respectively in FIGS. 2B, 3B, & 4B).

In the method, broadly described, tool 10 is initially run into a wellbore casing to a desired depth in the wellbore casing. During such run-in, and as shown in FIG. 2A and FIG. 6A, slidable sleeve 14 covers jet port 18. Frac port 50 may be in an open or closed position (show in the closed position in FIGS. 2B & 3B and in the open position in FIG. 4B), and likewise for bypass port 94 may be in an open or closed position (shown in the open position in FIGS. 2B, 3B and in the closed position in FIG. 4B). Thereafter, when the tool 10 has been lowered to the lowermost portion of the wellbore which is desired to be perforated and fracked, slight upward movement of tool 10 (ref. FIGS. 3A, 3B) puslls slidable sleeve 14 uphole, while guide member 60 and slips 62 thereon generally keep the remainder of tool 10 at a fixed position within the wellbore, thusly opening jet port 18 and jet nozzles 18'.

An abrasive pressurized fluid containing an abrasive compound such as uniformly sized sand particles or tungsten carbide filings of small uniform dimension, is then injected into bore 16. Such fluid not only enters chamber 40 through port 43 and caused piston 41 to compress uphole packer member 30 to thereby create a seal between tool 10 and the wellbore casing at such location, thereby preventing flow of abrasive fluid downhole, at such time the pressurised fluid is further expelled in a radially outward manner from jet ports 18 and jet nozzles 18' to thereby impinge upon the wellbore casing, and after a short time interval of impingement, perforate the casing at such location, with perforations equal in number to the number of jet ports 18 (ref. FIGS. 3A, 3B)

It is noted that slidable sleeve 14 in the method of the present invention need not necessarily be opened by slight upward force on the tool string and tool 10, as described above, but rather in an alternative embodiment shown in FIGS. 6A, 7A, and 8A, such slidable sleeve 14 is configured so as to form a chamber 22, and is opened by pressurized fluid being supplied to such chamber 22. This variation is described further below.

After the above perforation operation is performed, injection of pressurized abrasive fluid is ceased, and tool 10 may then be further drawn uphole to thereby position both the uphole packer member 30 and the lower (downhole) packer member 32 of tool 10 on the uphole and downhole side, respectively, of the created perforation, so as to effectively "straddle" the perforation with packer members 30, 32.

Thereafter, and as shown in FIGS. 4A & B, further downward force is re-applied reapplied to the tool 10 to move slidable sleeve 14 downward (downhole) to cover jet ports and to further actuate 'j' slot subassembly to allow wedge-shaped lower portion 90 of lower packer member 32 to be forced against jaw members 78, thereby causing such jaw members 78 to be forced radially outwardly and thus against the wellbore casing so as to thereby temporarily secure tool 10 within the wellbore casing. Simultaneously, by downhole packer member 32 being forced against jaw members 78 of guide member 60, the downhole packer member 32 is compressed and caused to expand radially outwardly, thereby creating a seal between the tool 10 and the wellbore casing at that location.

Thereafter, as shown in FIGS. 4A & B, pressurized fracking fluid is injected into bore 16, which causes piston member 41 in said tool 10 to compress said uphole packer member 30 and cause said uphole packer member 30 to expand radially outwardly, and thereby cause the pressurized fluid to pass into said the created perforation via frac port 50 in tool 10.

Thereafter, after completion of the fracking of the wellbore and this particularly location, supply of the pressurized fracking fluid is ceased and an upward force is then re-applied to the tool 10 to disengage jaw members 78 and allow re-positioning of tool 10 further uphole for creating further perforations and injecting further fracking fluid into further created perforations at such locations.

Figure 5:
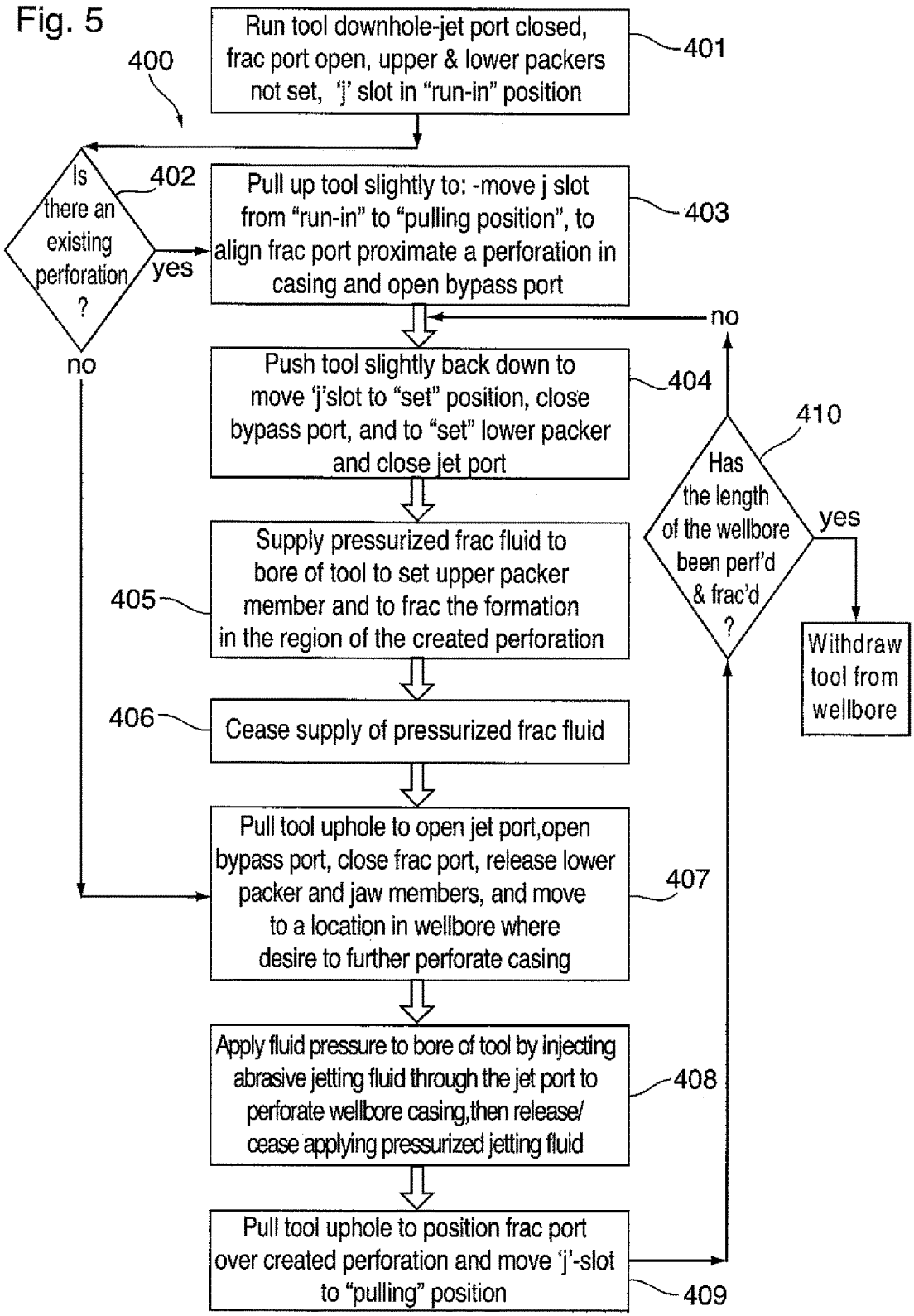
FIG. 5 is a flow diagram of a particular method of the present invention for perforating a wellbore casing and fracking the formation via the created perforations.

FIG. 5 shows a further elaboration/itemization of one particular method 400 of the present invention, using the tool 10 configuration shown in FIGS. 2A, B, 3A, 3B, & 4A, 4B, and where a bypass port 94 further is utilized.

In step 401, tool 10 is run downhole. Jet port 18 remains closed, and frac port 50 remains open, and neither upper packer member 30 or lower packer member 32 are "set" (i.e. compressed), thereby allowing the tool 10 to be run in into the wellbore, to a desired lowest depth where perforations and fracking is desired to be conducted. The 'j' slot subassembly 80, namely pin member 65 within slot "P" of mandrel 62, is in the "run in" position as shown in FIG. 2B If there is an existing perforation in the wellbore, the operator will, as shown in step 402, elect to proceed to step 403 to pull up slightly on the tool 10 to move the j-slot 80 from the run-in" position to the "pulling position" as shown in FIG. 3B, to thereby align frac port 50 proximate the perforation, and thereby also open bypass port 94 (If no existing perforation, the operate will proceed with step 407, described below). Thereafter, in step 404 the operator will push tool 10 slightly back down in the wellbore, to move 'j' slot subassembly 80 to the "set" position (ref. FIG. 4B), and simultaneously set (ie. compress) the lower packer member 32 and jaw members 78, close bypass port 94, and close jet port 18.

In subsequent step 405, pressurized frac fluid is then supplied to bore 16 to tool 10, to "set" (i.e. compress) upper packer member 30 by movement of piston 41, and frac fluid is injected into the formation in the region of the created perforation by supply of frac fluid to frac port 50 and thereby to the formation.

After fracking, tool 10 is pulled uphole in step 407 to thereby open jet port 18 and bypass port 94, release lower packer 32 and jaw member 78, and allow movement of tool 10 to an uphole location in the wellbore where desired to further perforate the casing.

In subsequent step 408, abrasive fluid is supplied to bore 16 of tool 10, and subsequently through jet port 18 to perforate the wellbore casing at such new uphole position, and thereafter the supply of such abrasive pressurized fluid is ceased.

In subsequent step 409, the tool 10 is pulled further uphole to position frac port 50 over the newly created perforation, and move 'j'-slot 80 to the "pulling" position.

If the desired length of the wellbore has not been completely perforated and fracked, the completion engineer reverts to step 404, and re-execute steps 404-409 at such further location in the wellbore. Otherwise, if at such point the wellbore has been completely perforated and fracked to the extent desired, the tool 10 can then be removed from the wellbore.

The operation of the configuration of tool 10, having the configuration shown in FIGS. 6A, 7A, & 8A, allows both perforation and fracking to be simultaneously carried out, and necessarily involves the abrasive fluid being one and the same as the frac fluid.

Such further refinement to the method 400 comprises simultaneously with step 405 injecting the abrasive/frac fluid, causing, by injection of such abrasive/frac fluid, the slidable sleeve 14 to move to an open position and expelling said abrasive/fracking fluid in a radially outward manner via said jet port 18 to thereby create a further perforation in the wellbore. Step 409 further comprises the step of repositioning the tool 10 further uphole so as to further position upper packer member 30 above the further created perforation, and again supplying the abrasive/fracking fluid to tool 10 when in such further position, to frac the formation in the region of the further perforation in the wellbore, and at the same time to further create an additional uphole perforation.

The foregoing description of the disclosed embodiments is provided to enable any person skilled in the art to make or use the present invention. The scope of the claims should not be limited by the preferred embodiments set forth in the examples, but should be given the broadest interpretation consistent with the description as a whole. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". In addition, where reference to "fluid" is made, such term is considered meaning all liquids and gases having fluid properties, as well as semi-solids such as tar-like substances.

For a complete definition of the invention and its intended scope, reference is to be made to the summary of the invention and the appended claims read together with and considered with the disclosure and drawings herein.

I claim:

1. A downhole tool for creating perforations in a wellbore casing and further injecting a fluid in the created perforations using such tool, comprising:

an elongate substantially cylindrical member, having a hollow bore and an outer periphery, adapted for insertion in a wellbore, said cylindrical member comprising:

(i) an uphole cylindrical, hollow slidable sleeve within said bore;

(ii) a jet port, situated in said outer periphery, configured to direct a stream of pressurized abrasive fluid radially outwardly from said tool, fluid communication of said jet port with said bore allowed and prevented by slidable movement of said uphole slidable sleeve;

(iii) an uphole packer member, situated on a portion of said periphery downhole of said jet port;

(iv) an expandable chamber and associated piston member, said chamber adapted to receive fluid under pressure from said bore and cause said associated piston member, when pressurized fluid is supplied to said bore, to compress and outwardly expand said uphole packer member;

(v) a downhole packer member, situated on a portion of said periphery downhole of said uphole packer member and spaced apart therefrom;

(vi) a frac port in said periphery of said cylindrical member, intermediate said uphole and said downhole packer members;

(vii) a slidably moveable guide member, having radially protruding slip members thereon, said slip members configured to frictionally engage said wellbore casing when said tool is inserted therein, said guide member situated on said tool downhole of said downhole packer member, said guide member further having radially expandable jaw members on an uphole side thereof;

(viii) a bypass port in said periphery, uphole or said downhole packer, configured when open to provide fluid communication between an exterior of said tool and said hollow bore;

(ix) a slidable valve member which slidably opens and closes said bypass port;

(x) a 'j' slot subassembly within said tool, situated downhole of said downhole packer member, and having an associated cylindrical hollow mandrel with a slotted profile therein;

wherein when downward force is applied to said tool and said guide member frictionally engages said wellbore casing, said 'j' slot subassembly does not allow further relative downward movement of a lower portion of said downhole packer member relative to said guide member and thus does not allow said jaw members to become actuated;

wherein when an upward pulling force is applied to said tool said slidable valve member is in an open position thereby keeping open said bypass port; and when thereafter a downward force is re-applied to said tool, said 'j' slot assembly is then configured in a 'set' position where:

(i) said lower portion of said downhole packer member is allowed further downward downhole movement to allow said lower portion of said downhole packer member to be forced against said jaw members so as to expand them radially outwardly to engage said wellbore casing; and (ii) when fluid pressure is then further applied to said hollow bore uphole of the slidable valve member the slidable valve member moves to a closed position thereby closing said bypass port.

2. A downhole tool for creating perforations in a wellbore casing and further injecting a fluid in the created perforations using such tool, comprising:

an elongate substantially cylindrical member, having a hollow bore and an outer periphery, adapted for insertion in a wellbore, said cylindrical member comprising:

(i) an uphole cylindrical, hollow slidable sleeve within said bore;

(ii) a jet port, situated in said outer periphery, configured to direct a stream of pressurized abrasive fluid radially outwardly from said tool, fluid communication of said jet port with said bore allowed and prevented by slidable movement of said uphole slidable sleeve;

(ii) an uphole packer member, situated on a portion of said periphery downhole of said jet port;

(iv) an expandable chamber and associated piston member, said chamber adapted to receive fluid under pressure from said bore and cause said associated piston member, when pressurized fluid is supplied to said bore, to compress and outwardly expand said uphole packer member;

(v) a downhole packer member, situated on a portion of said periphery downhole of said uphole packer member and spaced apart therefrom;

(vi) a frac port in said periphery of said cylindrical member, intermediate said uphole and said downhole packer members;

(vi) a slidably moveable guide member, having radially protruding slip members thereon, said slip members configured to frictionally engage said wellbore casing when said tool is inserted therein, said guide member situated on said tool downhole of said downhole packer member, said guide member further having radially expandable jaw members on an uphole side thereof; and (viii) a 'j' slot subassembly within said tool, situated downhole of said downhole packer member, and having an associated cylindrical hollow mandrel with a slotted profile therein;

wherein when downward force is applied to said tool and said guide member frictionally engages said wellbore casing, said 'j' slot subassembly does not allow further relative downward movement of a lower portion of said downhole packer member relative to said guide member and thus does not allow said jaw members to become actuated, and wherein when an upward pulling force is applied to said tool said uphole slidable sleeve is adapted to be slidably moved so as to uncover said jet port when said guide member and said outer periphery possessing said jet port remain stationary at a specific location within said wellbore casing and a portion of said tool uphole of said jet port and including said slidable sleeve, is raised uphole; and when thereafter a downward force is re-applied to said tool said 'j' slot subassembly is then configured in a 'set' position where:

(i) said lower portion of said downhole packer member is allowed further downward downhole movement to allow said lower portion of said downhole packer member to be forced against said jaw members so as to expand them radially outwardly to engage said wellbore casing.

3. The downhole tool as claimed in claim 1, wherein said uphole slidable sleeve is adapted to be moved so as to uncover said jet port by a pick-up tool insertable within said bore of said tool.

4. The downhole tool as claimed in claim 1, wherein said uphole slidable sleeve is configured to move so as to uncover said jet port when hydraulic fluid pressure is provided to said bore of said tool.

5. The downhole tool as claimed in claim 1, wherein said bore, in the region of said frac port, is provided with a deflector to deflect fracking fluid out said frac port.

6. The downhole tool as claimed in claim 1, further having an annular cup seal on said periphery of said tool intermediate said jet port and said downhole packer member, which reduces flow of abrasive pressurized fluid and associated wellbore casing cuttings downhole.

7. The downhole tool as claimed in claim 2, further comprising:

a bypass port in said periphery, uphole of said downhole packer, configured when oven to provide fluid communication between an exterior of said tool and said hollow bore and permit fluid exterior to said tool and above said downhole packer member to flow into said hollow bore; and a slidable valve member which slidably opens and closes said bypass port; and wherein when an upward force is exerted on said tool said slidable valve member is in an open position thereby keeping open said bypass port, and wherein subsequently actuating said 'j' slot to said 'set' position and when fluid pressure is further applied to said hollow bore uphole of the slidable valve member the slidable valve member moves to a closed position thereby closing said bypass port.

8. The downhole tool as claimed in claim 2, wherein said bore, in the region of said frac port is provided with a deflector to deflect fracking fluid out said frac port.

9. The downhole tool as claimed in claim 2, further having an annular cup seal on said periphery of said tool intermediate said jet port and said downhole packer member, which reduces flow of abrasive pressurized fluid and associated wellbore casing cuttings downhole.

* * * * *